United States Patent [19]

Hunt

[11] Patent Number: 4,777,710

[45] Date of Patent: Oct. 18, 1988

[54] APPARATUS AND METHOD USED IN MAKING WIRE AND SIMILAR ELONGATE MEMBERS AND WIRE MADE USING SAME

[75] Inventor: James G. Hunt, Terrace Park, Ohio

[73] Assignee: Polymet Corporation, Hamilton, Ohio

[21] Appl. No.: 41,472

[22] Filed: Apr. 23, 1987

[51] Int. Cl.[4] ..... B23P 17/00

[52] U.S. Cl. ..... 29/419.1; 29/599

[58] Field of Search ..... 29/419, 423, 599, DIG. 11; 139/425; 57/901

[56] References Cited

U.S. PATENT DOCUMENTS

| | | | |
|---|---|---|---|
| 2,050,298 | 8/1936 | Everett | 205/21 |
| 3,277,564 | 10/1966 | Webber | 139/425 R |
| 3,394,213 | 7/1968 | Roberts et al. | 264/174 |
| 3,505,039 | 4/1970 | Roberts et al. | 29/191.6 |
| 3,529,343 | 9/1970 | Gorton | 29/419 R |
| 3,785,036 | 1/1974 | Tada et al. | 29/419 R |
| 3,788,820 | 1/1974 | Hunt | 29/187 |
| 3,807,026 | 4/1974 | Takeo et al. | 29/419 R |
| 3,844,021 | 10/1974 | Hamada | 29/419 R |
| 4,027,511 | 6/1977 | Fuchs, Jr. | 29/419 R X |
| 4,209,122 | 6/1980 | Hunt | 29/423 |
| 4,323,186 | 4/1982 | Hunt | 29/419 R X |

*Primary Examiner*—Howard N. Goldberg
*Assistant Examiner*—Carl J. Arbes
*Attorney, Agent, or Firm*—Kinney & Schenk

[57] ABSTRACT

An apparatus and method used in making wire and similar elongate members, and wire made using same, are provided wherein rods are extruded using a filled billet technique which comprises disposing the rods in a can comprising the filled billet and additional steps are employed which comprise placing the rods in adjoining side-by-side relation to define a geometric pattern and fixing together at their ends those rods defining the periphery of the pattern to define a dense pack of the rods wherein the placing and fixing steps are achieved prior to the step of disposing the rods within the can, and wherein the dense pack and hence the rods are adapted to fit snugly within the can during the disposing step and separable filler means is added between and around the rods whereby the fixing step assures that during extrustion the rods are reduced in cross-sectional area in a better controlled manner. An apparatus and method used in removing the can from around the extruded rods are also provided together with an apparatus and method for separating the extruded rods.

48 Claims, 7 Drawing Sheets

APPARATUS AND METHOD USED IN MAKING WIRE AND SIMILAR ELONGATE MEMBERS AND WIRE MADE USING SAME

BACKGROUND OF THE INVENTION

1. Field of the Invention

This invention relates to the making of wire and similar elongate members and more particularly to the making of such wire utilizing a filled billet extrusion technique.

2. Prior Art Statement

It is known in the art to provide a method of making wire and similar elongate members of so-called high performance alloys wherein the method comprises the steps of providing a cylindrical can which has a closed end, an open end, and a central longitudinal axis; disposing a plurality of rods into the can through its open end in parallel relation with each other and parallel to the longitudinal axis; introducing a powdered filler material into the can to fill the spaces between the rods and the interior surface of the can; attaching a cap to the open end of the can to thus complete a filled billet; heating the filled billet to a temperature approximately equal to the forging temperature of the rods; extruding the filled billet through an extrusion die to effect an area reduction in the cross section thereof and of the rods therewithin; cooling the extruded filled billet; and removing the extruded can from around the extruded rods, and as disclosed in U.S. Pat. No. 4,209,122.

It is also known to manufacture elongate members of high performance alloys by the filled billet extrusion technique using stacked lamina disposed in a metal can and with each lamina having aligned perforations therein so that once the lamina are disposed in stacked relation associated perforations in the can are aligned to receive an elongate preform which is to be extruded and as disclosed in U.S. Pat. No. 3,788,820.

It is also known to form fine wire filaments by disposing a bundle of wires within a can, disposing metal powder between the wires and can or chordal sector pieces between the wires and can as disclosed in U.S. Pat. Nos. 3,394,213 and 3,505,039.

However in the above-mentioned prior art patents the application of heat and pressure, during extrusion, serves to bond the separate billet parts together; and, it is very difficult to mechanically remove the filler means (whether originally in the form of powder, plates, tubes, chordal sector pieces, or other form) from around the parts being processed. Acid is often required to remove such filler means by dissolution.

The high performance alloys referred to above are disclosed in U.S. Pat. No. 4,209,122 and thus will not be repeated because the entire teachings of such patent are incorporated herein by reference thereto. In addition, when the separable filler means is in the form of a powder, the basic desirable characteristics for such a powder disclosed in U.S. Pat. No. 4,209,122 are applicable to this invention and are also incorporated herein by reference thereto.

It is also known to provide a process for reducing metal rods, wires, strips and the like be drawing, rolling, and analogous operations (all of which utilize small compressive forces when compared to extrusion operations) by placing the rods, wires, strips and the like in a casing surrounded by a packing material to define a billet and then proceeding with reducing operations on such billet and as disclosed in U.S. Pat. No. 2,050,298.

Because of the above-mentioned small compressive forces drawing, rolling, and analogous operations are not suitable for making elongate rods of high performance alloys from castings.

However, the known apparatus and methods, including the ones disclosed in the above-mentioned patents have certain deficiencies which preclude the forming of wires and like elongate members of high quality and in an economical manner.

SUMMARY OF THE INVENTION

Accordingly, it is a feature of this invention to provide a new apparatus and method which substantially overcome the above-mentioned deficiencies.

Another feature of this invention is based on the discovery, obtained experimentally, that mechanical separation of extruded elongate members or wires can be readily achieved by using a separable filler means or filler such as a filler powder, or the like, which after extrusion, and at room temperature, is quite brittle, especially if the wires are only weakly bonded to the extruded brittle filler and to one another. This condition is achieved using a filler which has present a sufficient volume fraction of embrittling phases or is brittle by nature. The condition is enhanced by extruding rods which have their surfaces coated with a coating material which reduces and preferably prevents ductile metallurgical boding between the filler and the rods and between the rods themselves whereby such coating material serves as a parting agent. The ease of mechanical separation reaches a maximum, when the fracture path in the filler is at a minimum. This condition occurs when the areas of contact between the rods are at a maximum, that is, when each rod touches the maximum number of its neighbors. In accordance with the discovery of this invention, the filler should become brittle enough or frangible enough after extrusion that the wires can be easily separated by fracturing the filler with small mechanical forces. Such forces can be easily produced manually with simple hammering, or similar method.

Another feature of this invention is to use a suitable coating material or parting agent having characteristics which are closely similar to the characteristics of the filler. However, at room temperature and after extrusion such a coating material is preferably more brittle.

Another feature of this invention is the aforementioned discovery that the minimum force of fracturing or maximum frangibility of the filler is proportional to the proximity of suitably coated rods to each other. Greatest ease of separation occurs when the rods are coextruded with the densest packing or when the area of contact between the rods is at a maximum.

Another feature of this invention is to provide a new method of manufacturing wire and similar elongate members comprising the steps of providing a cylindrical can which has a closed end, an open end, and a central longitudinal axis; disposing a plurality of rods into the can through its open end in parallel relation with each other and parallel to the longitudinal axis; introducing separable filler means into the can to fill the spaces between the rods and between the rods and the interior surface of the can; attaching a cap to the open end of the can to thus complete a filled billet; heating the filled billet to a temperature approximately equal to the forging temperature of the rods; extruding the filled billet through an extrusion die to effect an area reduction in the cross-section thereof and of the rods therewithin; cooling the extruded filled billet; and removing the extruded can from around the extruded rods.

In accordance with one embodiment of this invention, the new method comprises placing the rods in adjoining side-by-side relation to define a geometric pattern, fixing together at their ends those rods defining the periphery of the pattern to define a dense pack of the rods, with the placing and fixing steps being achieved prior to the disposing step and with the dense pack and hence the rods being adapted to fit snugly within the can during the disposing step. The fixing step assures that during the extruding step the rods are reduced in cross-sectional area in a better controlled manner and are more easily separated from one another by entirely mechanical means.

In accordance with another embodiment of this invention, the removing step of the method comprises the billet preparation steps of cutting at least one slot in and along substantially the full length of the can and partially through the thickness of such can, inserting a strip in the slot and attaching same so that during the extruding step the strip is also extruded with the filled billet; and following the extruding step cutting away at least one end of the extruded billet to expose the associated end of the extruded rod and an associated end of the extruded can, removing the extruded strip to define a weakened zone along the extruded can, grasping the associated end of the extruded can, and mechanically stripping the extruded can away from the extruded rods by a peeling action which results in splitting the extruded can along the weakened zone and removal of such can from the rods.

In accordance with another embodiment of this invention side-by-side elongate rods, which are held together as a result of filled billet extrusion and materials used in association therewith, are more readily separated by a novel apparatus and method.

In accordance with another embodiment of this invention, the step of introducing separable filler means comprises introducing filler means which during said extruding step remains or becomes frangible and the new method comprises the further step of separating the extruded rods from each other by breaking said frangible filler means with comparatively small mechanical forces.

In accordance with another embodiment of this invention, a new method is provided which comprises coating, prior to filled billet extrusion, rods of the character mentioned and the inside surface of their associated cylindrical can with coating means which serves as a parting agent.

Accordingly, it is an object of this invention to provide a new method of manufacturing wire and similar elongate members with the method of this invention having one or more of the novel features as set forth above or hereinafter shown or described.

Another object of this invention is to provide new apparatus used in manufacturing wire and similar elongate members.

Another object of this invention is to provide an improved wire or similar elongate member utilizing the improved apparatus and method of this invention.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DESCRIPTION OF PREFERRED EMBODIMENTS

Figure 1:
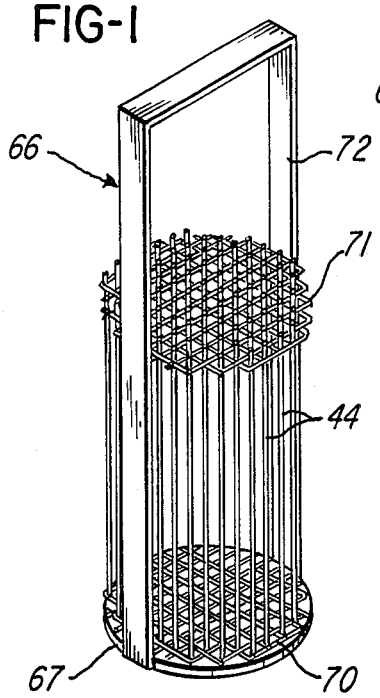
FIG. 1 is an isometric view of a device utilized to coat and dry metal rods prior to extrusion of same in accordance with the teachings of this invention and showing a plurality of rods disposed within the device standing on their ends in parallel relation.
Figure 2:
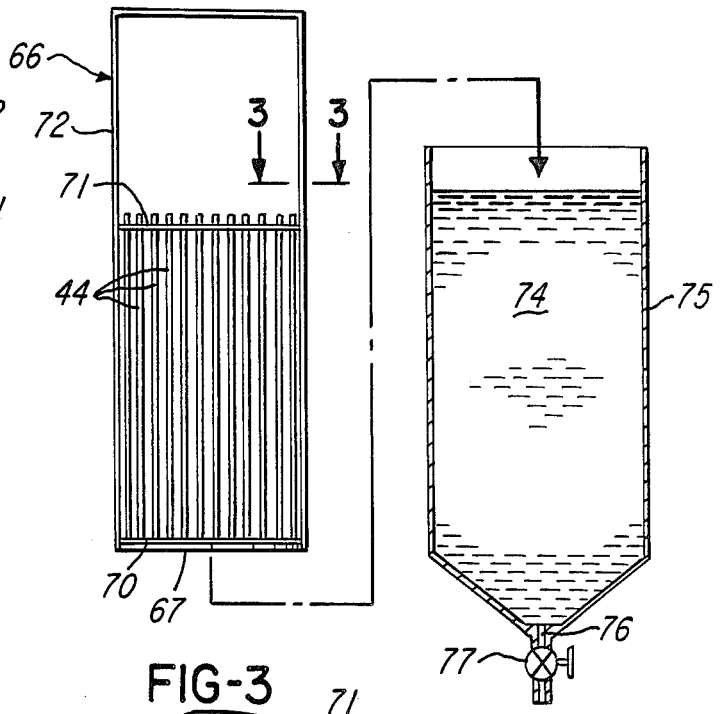
FIG. 2 illustrates a side view of the device with the rods therewithin and illustrating the manner in which such rods and device are disposed within a dipping tank containing a coating material to enable coating of such rods about their outer surfaces wherein such coating material serves as a parting agent.

While the various features of this invention are hereinafter illustrated and described as being particularly adapted to provide a method and apparatus used in manufacturing wire or rods and similar elongate members and wire or rods made using the method and apparatus, it is to be understood that the various features of this invention can be utilized singly or in various combinations using techniques known in the art to provide or make other products.

Therefore, this invention is not to be limited to only the embodiments illustrated in the drawings, because the drawings are merely utilized to illustrate certain ones of the wide variety of uses of this invention.

Figure 11:
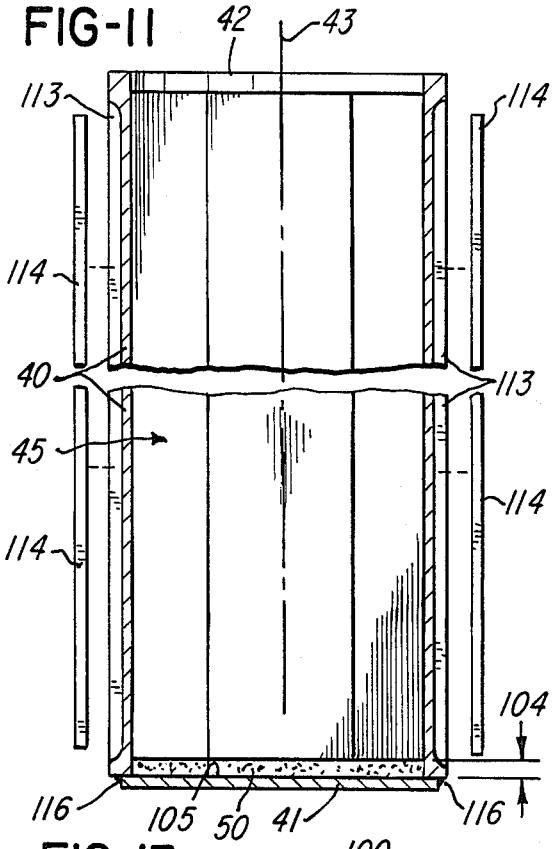
FIG. 11 is a view primarily illustrating the manner of disposing the dense pack of rods in an open ended cylindrical can together with filler means therearound and the provision of slots in such can and strips to be disposed in such slots.
Figure 12:
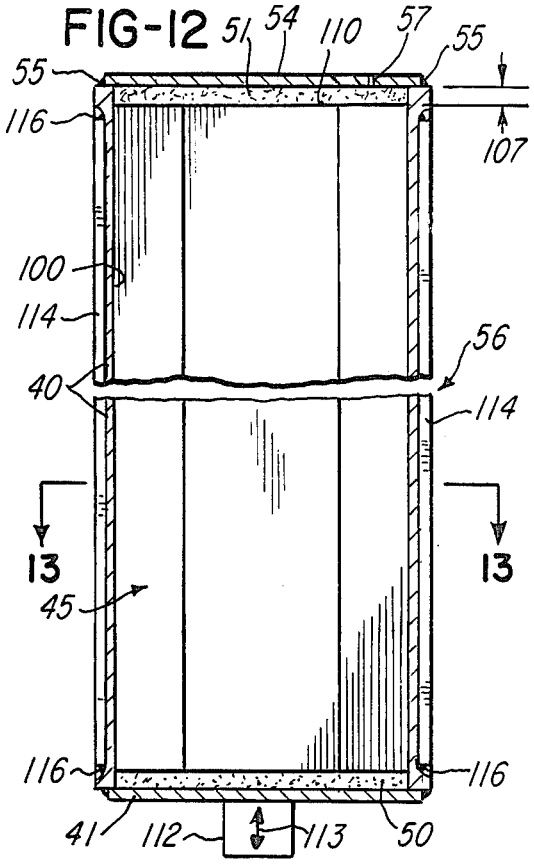
FIG. 12 is a view similar to FIG. 11 illustrating a cap attached to the open end of the can after filling the can with filler means and welding at opposite ends thereof the strips of FIG. 11 in such slots.
Figure 13:
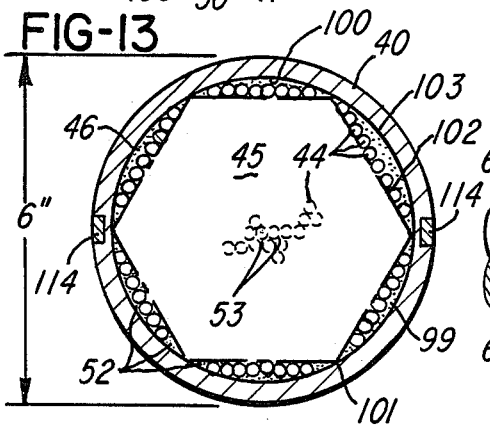
FIG. 13 is a view taken essentially on line 13—13 of FIG. 12.

Reference is now made to FIGS. 11–13 of the drawings wherein in accordance with the teachings of this invention a cylindrical can which is designated generally by the reference numeral 40 is provided and such a can has a closed end 41, an open end 42 and a central longitudinal axis 43. The can 40 is particularly adapted to be used to define the enclosing container in which a plurality of rods which are to be extruded are disposed and extrusion is achieved in accordance with a filled billet technique which is known in the art.

Referring to FIG. 13 it is seen that a plurality of rods, each designated generally by reference number 44, and with only a few of such rods being so designated, are provided as a dense pack, as will be subsequently described, of such rods and such dense pack is designated generally by the reference numberal 45. Rods 44 in dense pack form, as well as other rods 44, are disposed into the can 40 through its open end 42, shown in FIG. 11, whereby the rods 44 are disposed in parallel relation with each other and parallel to the longitudinal axis 43. Filler means in the form of powdered filler material 46, which becomes frangible after consolidation due to extrusion, is introduced into the can, shown in FIG. 12, to fill the spaces between the rods and between the rods and the surface of the can and such filler material is shown at 50, 51, 52, and 53 in FIGS. 12 through 13. A metal closure cap 54 is then fixed in position over the open end 42 of the can 40 utilizing an annular weld 55 to define a completed filled billet which is designated generally by the reference numeral 56.

The filled billet 56 is heated as is well known in the art and basically as taught in U.S. Pat. No. 4,209,122 and the basic teachings and disclosure of the U.S. Pat. No. 4,209,122 is incorporated herein by reference thereto and thus will not be repeated. The metal cap 54 has a small hole 57 therein, shown in FIG. 12, and hole 57 is used as a vent allowing moisture and gases to escape during the preheating and extrusion of the filled billet 56.

The filled billet 56 is preheated for a number of hours sufficient for all portions of billet 56 to be evenly heated and in some applications of this invention four to six hours has been a sufficient time. The temperature of preheating is selected to be compatible with the properties of the rods being processed.

Figure 14:
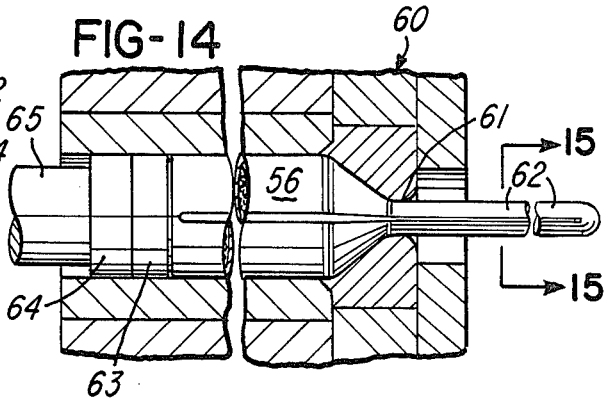
FIG. 14 is a fragmentary view illustrating an extrusion tooling assembly and extrusion of a filled billet thereby.
Figure 15:
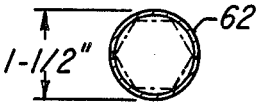
FIG. 15 is an enlarged cross-sectional view taken essentially on line 15—15 of FIG. 14.

The preheated billet is then extruded through an extrusion die, which is designated generally by the reference numeral 60 in FIG. 14. The extrusion die 60 is comprised of the usual conventional component parts which will not be described in detail. However, it will be appreciated that such extrusion die 60 has the usual die orifice 61 in the forward end thereof which is designed to provide the desired cross-sectional configuration and area reduction from the cross-sectional configuration and area of the filled billet 56 to define the extruded filled billet which is designated generally by the reference numberal 62 in FIG. 14. The extrusion tools include the usual graphite seal 63 which serves to prevent all back extrusion of filled billet 56, and a hardened, preheated dummy block 64 is disposed between an actuating ram 65 of the extrusion press and the seal 63.

In this example of the invention the extrusion is such that there is a reduction in diameter to one-fourth of the original diameter. In particular, the outside diameter of the can 40 is reduced from 6 inches to approximately 1½ inches. This reduction in diameter results in a reduction in the cross-sectional area of the filled billet and individual rods so that such billet and rods are 1/16th of their original respective areas. To accomplish extrusion of a particular filled billet 56 in one application of this invention required the application by ram 65 of approximately 2,500 tons of force or roughly 80 tons per square inch pressure. After extrusion of the filled billet 56 to define the extruded filled billet 62, the extruded filled billet 62 is cooled whereupon the extruded can is removed from around the extruded rods and each of the extruded rods is then removed from the bundle of extruded rods in accordance with further teachings of this invention and further processed also in accordance with the teachings of this invention.

Figure 4:
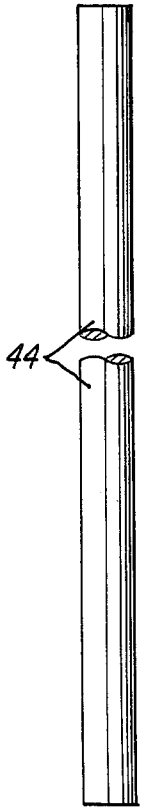
FIG. 4 is a view of a typical rod with the central portion thereof broken away prior to coating thereof with the coating material.

Reference is now made to FIG. 4 of the drawings which illustrates a typical metal rod which may be a so-called high performance alloy rod of the type described in the previously mentioned U.S. Pat. No. 4,209,122. Rods 44 are coated with a suitable coating material, as will now be described, preferably using a suitable coating device which is designated generally by the reference numeral 66 in FIG. 1. The device 66 is used for disposing therein and standing a plurality of rods 44 on their ends so that such rods are disposed in parallel spaced apart relation.

Figure 3:
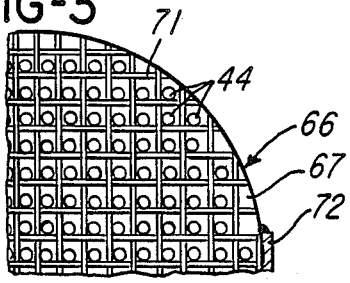
FIG. 3 is an enlarged fragmentary view taken essentially on the line 3—3 of FIG. 2.

Referring to FIG. 1 of the drawings, it is seen that the device 66 has a bottom wall 67 which supports a mesh-like member 70 thereon and a mesh-like member 71 is provided and defines the upper portion of the device 66. The members 67, 70, and 71 are fixed together in their respective positions by an inverted U-shaped hanger 72 which is fixed to opposite side edges of the members 67, 70 and 71. As shown in FIG. 3, the rods 44 are disposed with substantial space therebetween so that such rods may be coated with a suitable coating material while in the device 66.

Coating material for the rods 44 in this example is provided as a substantially liquid coating material 74. The liquid coating material 74 is provided in a dipping tank 75 containing same. The tank 75 may be provided with a suitable outlet 76 and such outlet may have an on-off shut-off valve 77 provided in the outlet 76 for the usual purposes.

Figure 5:
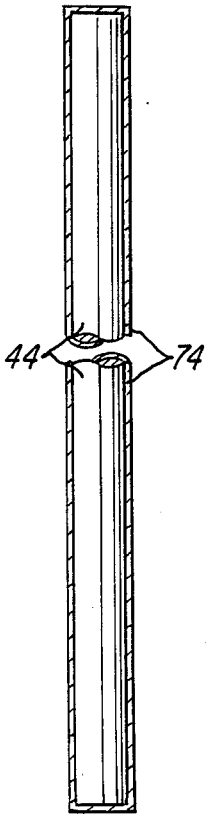
FIG. 5 is a view of a typical rod with the central portion broken away and after coating thereof with the coating material prior to extrusion and showing coating material on its outside surface in cross section, including the ends thereof.

The rods 44 are coated by immersing same in the coating material 74 while supported in the device 66. The device 66 and rods 44 are lifted out of the tank and coating material 74 and allowed to air dry whereupon a coating 74 is provided on each rod 44 as shown in FIG. 5 of the drawings. The coating 74 may be considered a continuous coating or a continuous phase structure which is provided about the entire cylindrical surface of each rod 44.

The rods 44 are coated with the coating material 74 prior to disposing such rods into the can 40 to enable such rods to be more readily and easily separated from each other following the extrusion step. In accordance with the teachings of this invention and after the rods are coated as described above, such rods are placed in adjoining side-by-side relation to define a geometric pattern. Certain rods defining the periphery of the geometric pattern are then fixed together at their ends, by welding, to define the previously mentioned dense pack 45 of said rods and it will be appreciated that the placing and fixing steps are achieved prior to the step of disposing the dense pack and rods within the open-ended can 40. It will be appreciated that the ends of the rods which are to be welded are first suitably cleaned. As will be apparent from FIG. 13 of the drawings, the dense pack 45 and hence the rods 44 are adapted to fit snugly within the can during the step of disposing the rods within the open end of the can and the step of fixing the rods assures that during the extruding step the rods are reduced in cross-sectional area in a better controlled manner.

Figure 6:
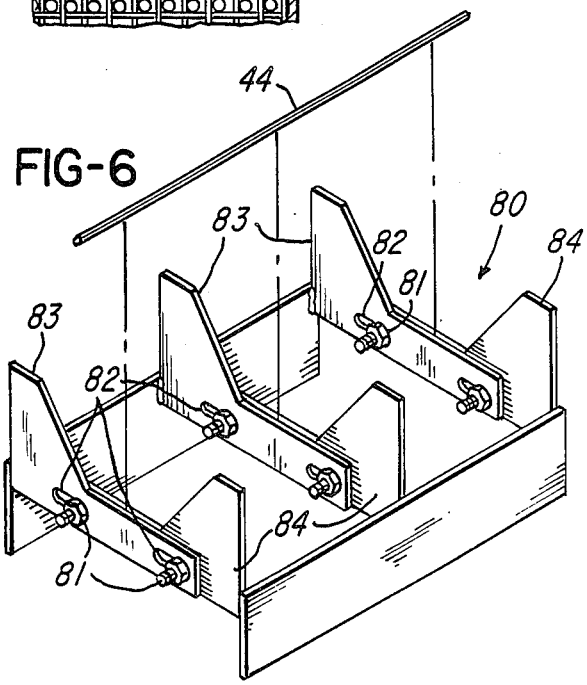
FIG. 6 is an isometric view illustrating adjustable fixture means utilized to define and hold for fixing purposes a half pack of coated rods, as will be described herein.
Figure 7:
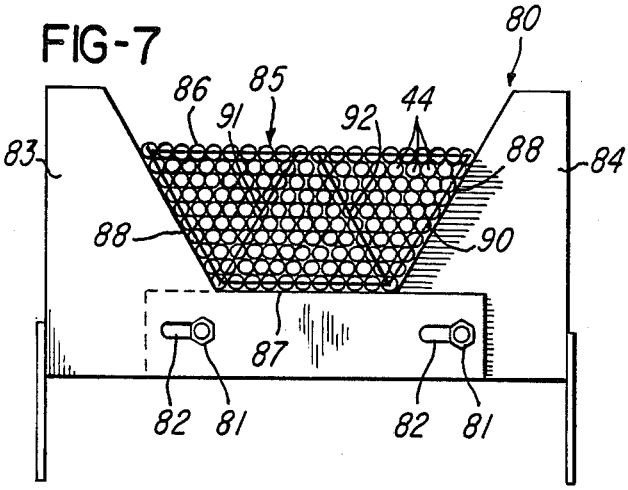
FIG. 7 is an end view of a half pack of coated rods in the fixture of FIG. 6 to enable fixing the rods together in a certain manner at their ends by welding after removing the coating material from the ends of selected rods which are to be welded.

The placing step comprises placing the rods into fixture means shown as an adjustable fixture means or fixture 80 in FIGS. 6 and 7. The adjustment of the fixture is achieved by a plurality of fixture fasteners 81 each consisting of a cooperating threaded bolt and nut. Each fastener 81 operates in connection with associated elongated slots 82 provided in cooperating components 83 and 84 of the fixture 80 in a manner well known in the art. Rods 44 are placed in the fixture 80 to define two substantially identical patterns each having one-half of the rods of a dense pack 45 disposed in adjoining side-by-side relation. Those rods which define the periphery of each preliminary pattern which consists of one-half of a dense pack 45, i.e., a half pack 85, are fixed together by welding. The half packs are then fixed together as by welding to define the dense pack as will now be more fully described.

Figure 10:
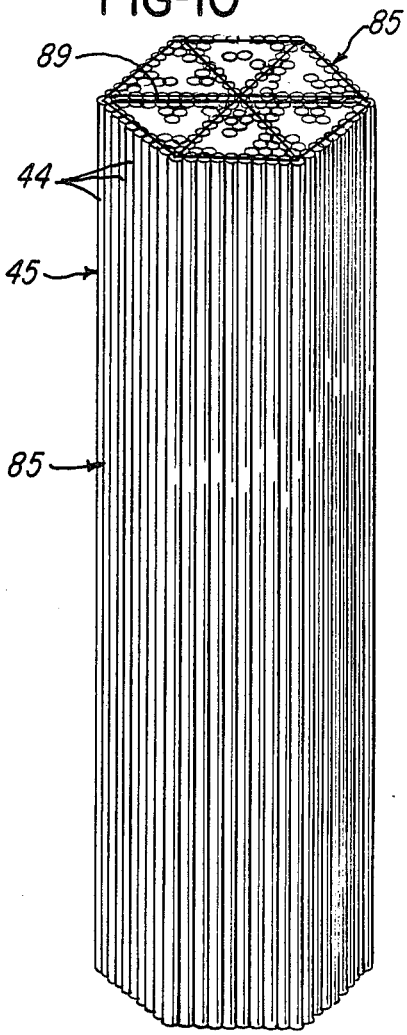
FIG. 10 is an isometric view of a typical dense pack after welding together a pair of associated half packs.

The rods 44 defining the half pack 85 are disposed in the fixture 80 to enable compaction thereof and arrangement of such rods in a trapezoidal pattern when viewed from an end thereof, as shown in FIG. 7 of the drawings. The trapezoidal pattern has long and short parallel sides designated by the reference numerals 86 and 87 respectively and non-parallel sides of equal length each designated by the same reference numeral 88. The trapezoidal pattern defines an associated one of the two preliminary patterns and the welding is achieved by welding together at their ends those rods 44 defining the periphery of each trapezoidal pattern as shown by peripheral trapezoidal weld line 90. Two half packs 85 are then welded together along their long parallel sides 86 as shown at 89 in FIG. 10 to define the dense pack 45 as a hexagonal dense pack when viewed from an end thereof.

Figure 9:
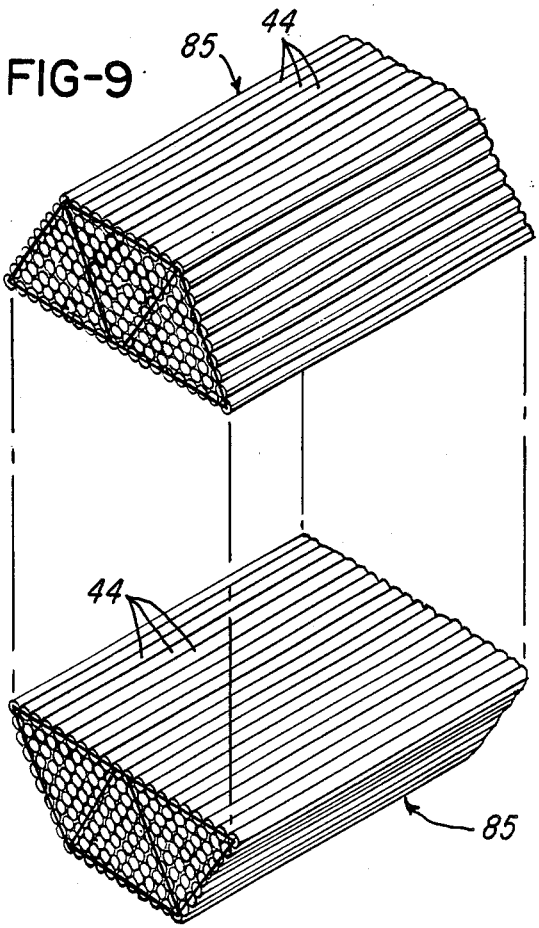
FIG. 9 is a fragmentary isometric view illustrating the manner in which two half packs are disposed together to enable welding thereof to form a dense pack which is of hexagonal configuration when viewed from an end thereof.

In addition to welding together at their ends those rods 44 which define the periphery of each preliminary trapezoidal pattern, certain ones of the rods which are disposed within the periphery of the trapezoidal pattern are also welded. In particular, certain rods mentioned above are rods arranged in a V-shaped pattern within the periphery of each trapezoidal pattern. The rods arranged in such V-shaped pattern comprise the rods disposed along the lines 91 and 92 (FIG. 7). Those rods arranged on the lines 91 and 92 are welded together at their ends so that each half pack has rods welded to define three isosceles triangles. The three isosceles triangles referred to will be readily apparent from the half pack illustrated in FIG. 7 and each of the half packs illustrated in FIG. 9 and the dense pack illustrated in FIG. 10.

Figure 8:
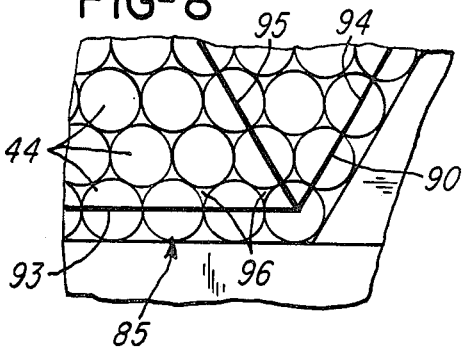
FIG. 8 is an enlarged view illustrating the weld pattern along the ends of certain ones of the selected rods.

The welding of the peripheral rods and the welding of the rods along the lines 91 and 92 is achieved by welding the cleaned ends of such rods only along the center lines of the rods as illustrated typically at 93, 94, and 95 in FIG. 8. With this arrangement, it will be appreciated that powdered filler material may be introduced into the can to fill the spaces illustrated typically at 96 between rods 44.

As previously mentioned, the rods 44 are disposed within the can 40 in parallel relation. Prior to disposing the rods within the can, the inside surface of the can is also coated with a coating material or parting agent which enables the separation of the extruded can from around the extruded rods following the extruding step. It will also be appreciated that the can 40 is a cylindrical can with a right circular cylindrical inside surface 100 as shown in FIG. 13. During the disposing step the hexagonal dense pack 45 is disposed within the can so that the corners 101 thereof are substantially against the cylindrical inside surface 100. It will also be appreciated that the disposing step further comprises placing the rods in each chordal space 99 between a straight substantially planar wall, shown typically at 102 in FIG. 13, of the hexagonal dense pack 45 and an arcuate portion 103 of the cylindrical inside surface 100 of the can 40.

As previously mentioned, a powdered filler material 46 is introduced in the can 40 to fill the spaces between the rods 44 and between the rods and the interior surface of the can, and the powdered filler material 46 will be described in detail subsequently. Referring again to FIGS. 11 and 12 of the drawings, the introducing of powdered filler material 46 in the can comprises introducing prior to disposing the dense pack 45 in position a predetermined thickness indicated at 104 of powdered material into the can against the inside surface 105 of the closed end of such can with the can disposed in a upright manner and as shown at 50. Disposal of the thickness 104 is followed, after disposal of the dense pack 45 thereon, by introducing powdered filler material 46 between the rods themselves, as shown at 53 in FIG. 13, (in the spaces 96, shown in FIG. 8) and between the rods 44 and the cylindrical inside surface 100 of the can, as shown at 52 in FIG. 13. This is followed by introducing a predetermined top thickness, shown at 107 in FIG. 12, of powdered filler material on the top surface 110 of the hexagonal dense pack 45, as shown at 51, and within the cylindrical surface of the can 100. The end closure 54 is then welded to the top open end 42 of the can utilizing in the peripheral weld 55 as previously described.

During the step of disposing the thickness 104 of powdered filler material 46 at the bottom of the can 40, disposing such material within the dense pack itself and about its periphery, and disposing the thickness 107 of powdered filler material in the top of the can 40 over the dense pack 45, the can 40 is vibrated utilizing a suitable vibrating device of any type well known in the art. Vibration of the can and its contents compacts and densifies the powdered filler material as it is being introduced into the can.

The vibrating device may be of any suitable type known in the art and is indicated schematically by black box 112 at the bottom of the can 40 in FIG. 12. A double arrow 113 within the box 112 indicates the vibratory motion provided by the device 112.

In accordance with further teachings of this invention a method and apparatus heretofore unknown is provided for removing the extruded can from around the extruded rods in a manner heretofore not known in the art of filled billet extrusion. In particular, the step of removing the can from around the extruded rods comprises the preparation step, prior to the disposing step, of cutting at least one slot in and along substantially the full length of the can 40 and partially through the thickness of the can. In this example of the invention, two parallel slots, shown in FIG. 11, and each designated generally by the reference numeral 113 are cut along substantially the full length of the can 40 and parallel to the longitudinal axis of the can. Two strips each designated by the same reference numeral 114 are disposed as shown in FIG. 12 in the slots 113. Each strip 114 is disposed in an associated slot and typically attached at its opposite ends as by a pair of welds, each designated by the same reference numeral 116. During the extruding step it will be appreciated that the strips are also extruded together with the filled billet.

Figure 16:
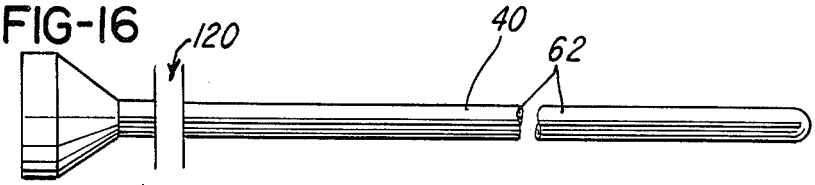
FIG. 16 is a view with parts broken away showing the completed extruded billet with the butt end portion of the filled billet after cutting same away from the extruded portion.
Figure 17:
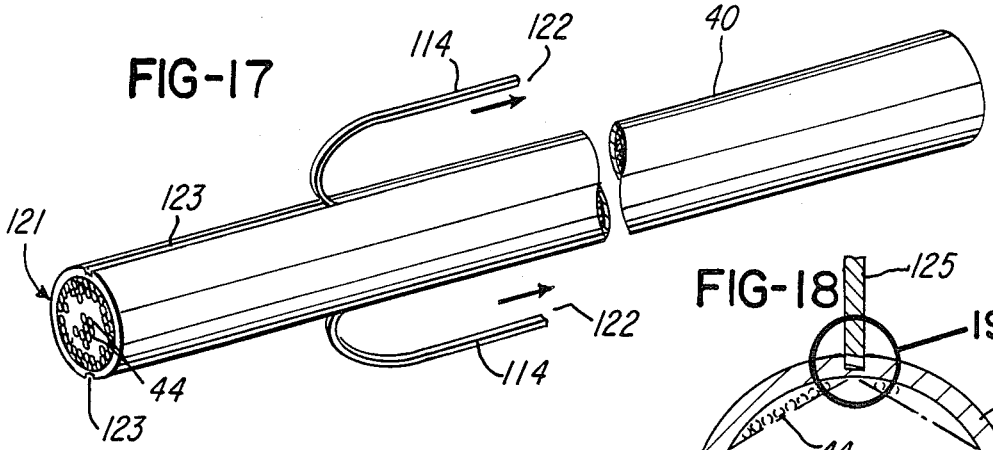
FIG. 17 is an isometric view illustrating the manner of removing the metal strips which were disposed in the slots provided in the metal can prior to the extruding step to expose spaces previously occupied by such strips and define guides for a saw blade and an associated guide fixture.

Following the extruding step at least one end of the extruded billet is cut away as shown at 120 in FIG. 16 to expose the associated ends of the extruded rods and an associated end of the extruded can, still designated generally by the reference numeral 40, and as shown at 121 in FIG. 17. The extruded strips are designated by the reference numerals 114 in FIG. 17, as before, and such extruded strips are removed as shown at 122 in FIG. 17 to expose weakened zones 123 along the extruded can. The extruded can 40 may then be mechanically stripped away from the extruded rods by splitting such extruded can along the weakened zones without the need for further cutting or weakening of the extruded can.

Figure 18:
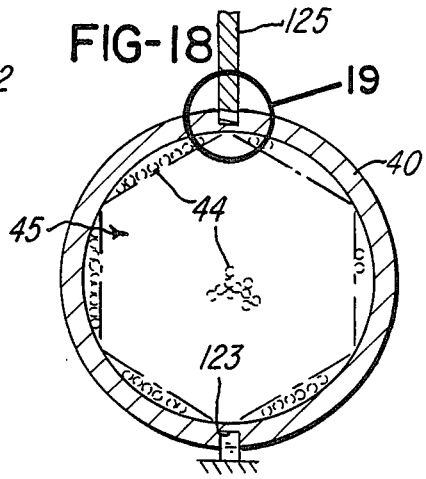
FIG. 18 is an end view schematically illustrating a saw being used to cut essentially through the can beneath an exposed space to enable peeling away of the extruded can.
Figure 19:
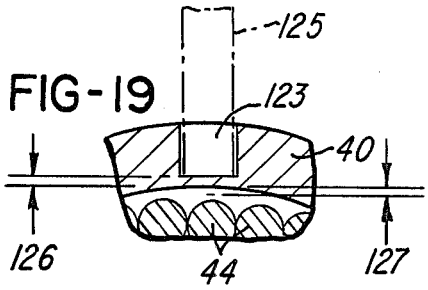
FIG. 19 is an enlarged fragmentary view illustrating that the saw may be used to cut completely through the extruded can.
Figure 20:
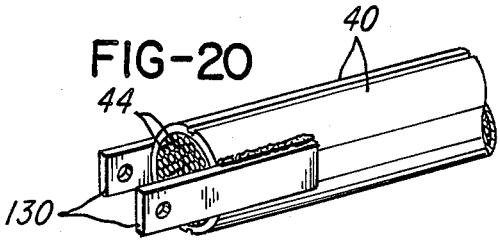
FIG. 20 is a fragmentary isometric view illustrating a pair of tabs welded to the extruded can to enable grasping and peeling of the extruded can away from the extruded billet to define a bundle of weakly held-together extruded rods.

However, in accordance with the teachings of this invention each weakened zone may be further extended completely through the wall thickness of the extruded can 40 or to a greater depth through such wall thickness in the manner illustrated in FIGS. 18–19. Accordingly, each original weakened zone 123 may be utilized as a guide zone for a rotary saw such as an abrasive saw cutter 125, or the like, to prevent the rotary cutter from sliding away from its desired position along the can 40 during cutting. As indicated earlier, the cutting action may be such that the cut may be provided completely through the thickness of the extruded can 40, either continuously or intermittently. Further, it will be appreciated that the arrangement of rods 44 may be such that the cutter may cut completely through the wall thickness of the extruded can 40 before it touches or comes into contact with the extruded rods 44.

Figure 21:
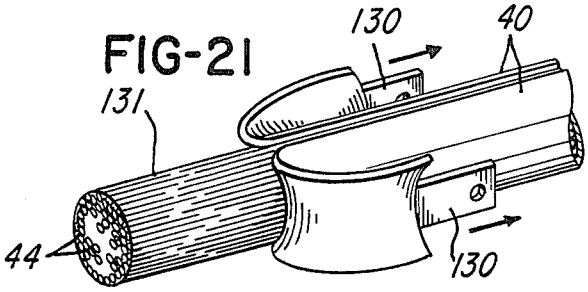
FIG. 21 is a view similar to FIG. 20 showing the peeling of the extruded can.

As seen in FIG. 19 the cutter 125 may be operated to cut through the wall of extruded can 40 so that a thickness 126 of such can remains. The cutter 125 has a distance 127 that it may travel before it will come into contact with the extruded rods. After cutting through the weakened zones 123, as shown in FIGS. 18–19, tabs 130 are preferably welded to the associated ends of the extruded can 40 whereupon the associated halves of the extruded can are peeled away as shown in FIG. 21 using any suitable means. However, each tab 130 may be attached to a suitable winch (not shown) and the associated part of the extruded can 40 pulled away from its bundle of extruded rods utilizing the action of the winch to provide a peeling action in much the same way as a strip is pulled away from a sardine can of the type which utilizes a metal strip and a key. In this example each tab 130 is used to pull away roughly an associated half of an extruded can 40 from the extruded wire bundle 131 which is shown in FIGS. 21 and 22.

Figure 22:
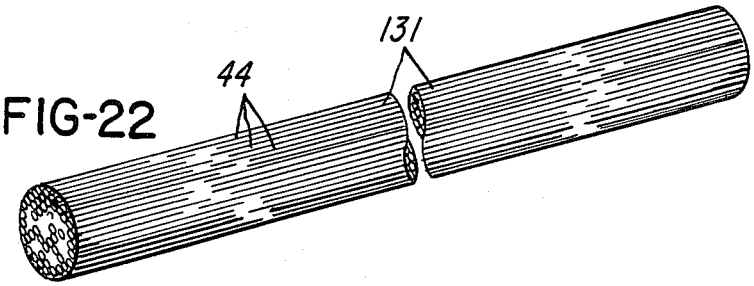
FIG. 22 is an isometric view with the central portion thereof broken away illustrating the bundle of extruded rods with the extruded can removed therefrom.

Once the can halves are pulled away utilizing the tabs 130, the completely exposed bundle of elongated extruded rods or wires remains, as shown in FIG. 22. The extruded rods 44 of FIG. 22 are weakly bonded together due to their adherence to the powdered filler material which has solidified thereon and therebetween, essentially as a matrix-like frangible substance, during extrusion.

It will be appreciated that prior to this invention the extruded can 40 would have ordinarily been removed by a machining operation and/or by chemical action; and these techniques are both time consuming and expensive. However, with the apparatus and method of this invention the extruded can 40 is removed with optimum simplicity in a minimum of time and with minimum use of dangerous materials that could potentially contaminate the environment.

In this example of the invention a plurality of two weakened zones and strips therefor are provided in the can 40 at diametrically opposed locations in such can. However, any desired number of weakened zones and strips may be provided and regardless of the number provided such zones may be further weakened by a rotary cutter, or the like, as described earlier. In the case of a single weakened zone such single zone may be in a helical pattern around the can. Alternatively, in another case of a single weakened zone, such single zone may extend straight along one side of the can 40; and, after extrusion the extruded filled billet may be rolled with flat rolls to compress the can nearly circular in cross section to a cross-sectional shape like an elipse, and outwardly away from the extruded rods and thereby substantially loosen the extruded rods or wires 44 from the can and possibly from each other prior to removing the can 40. After removal of its associated strip and welding of an associated tab 130 to an end of the extruded can, such can may be stripped away from the remaining bundle of extruded rods in much the same way as the can halves were stripped away in the illustration of FIG. 21. It will also be appreciated that more than two slots and strips may be utilized and each portion of can between slots and strips is suitably stripped away from the bundle with an associated winch or other suitable means or device.

Having arrived at the bundle 131 illustrated in FIG. 22 and comprised of weakly bonded extruded rods, usually bonded together by solidified frangible or friable, originally powdered filler material therebetween, it will be appreciated that in the prior art it was common practice to utilize acid or other solution in which the bundle would be dipped to separate the extruded rods from each other. However, in accordance with the teachings of this invention, a rod separation apparatus which is designated generally by the reference numeral 133 in FIG. 23 is provided.

The apparatus 133 is comprised of two semi-cylindrical portions 134 and 135 joined together by an intermediate portion 136 to define a clam shell arrangement. The portions 134 through 136 are suitably supported on a plurality of stands 137 with only one of such stands being shown.

The apparatus 133 also comprises an endless mechanism 140 having a plurality of separating devices or strippers 141 disposed therealong in spaced apart relation and the mechanism of this example is a chain mechanism 140 which is driven by a drive sprocket 139 which is in turn driven by a suitable drive motor (not shown).

Figure 23:
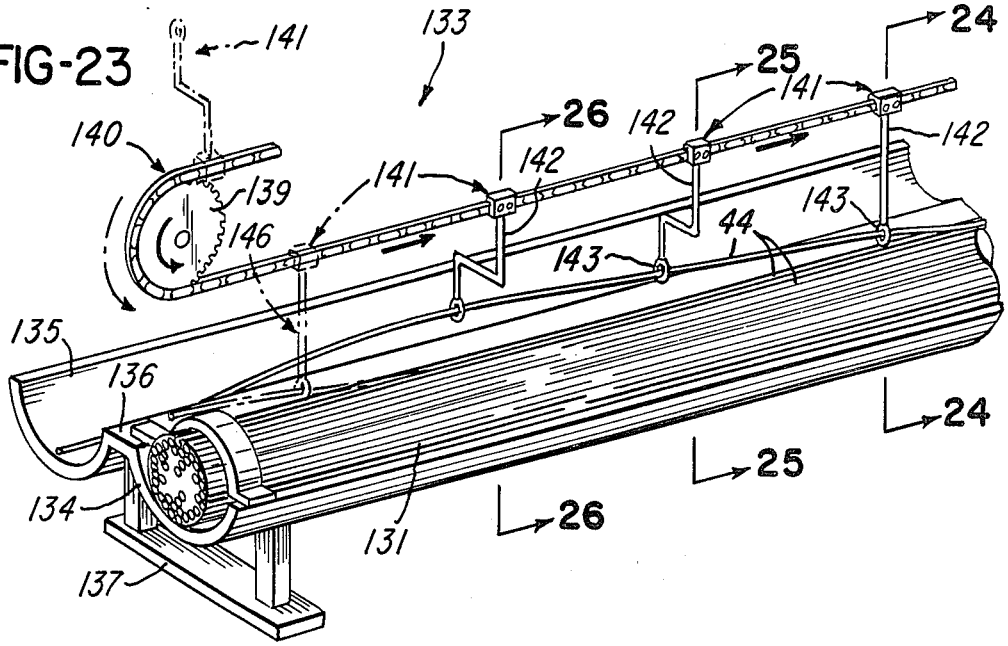
FIG. 23 is a view illustrating an apparatus which may be utilized to remove the extruded rods from the bundle of FIG. 22 in an individual manner with minimum bending.
Figure 24:
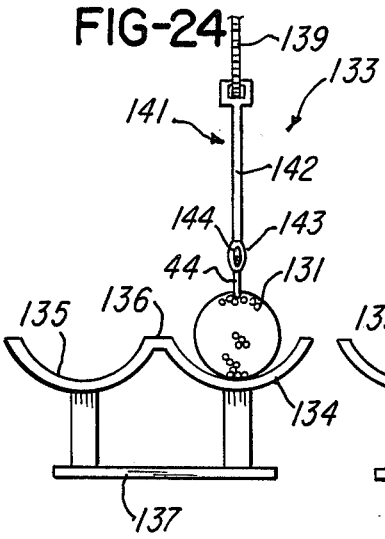
FIGS. 24, 25, and 26 are views taken essentially on the lines 24—24, 25—25 and 26—26 respectively of FIG. 23 illustrating the manner in which wire hangers having loops therein engage and receive an individual rod therein to separate and remove same from its bundle after extrusion and placement of such individual rod in an associated cradle comprising the apparatus of FIG. 23.
Figure 25:
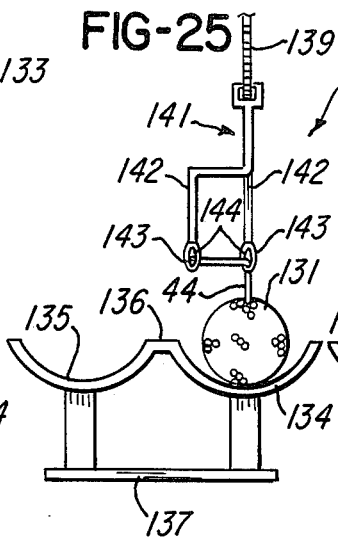
Figure 26:
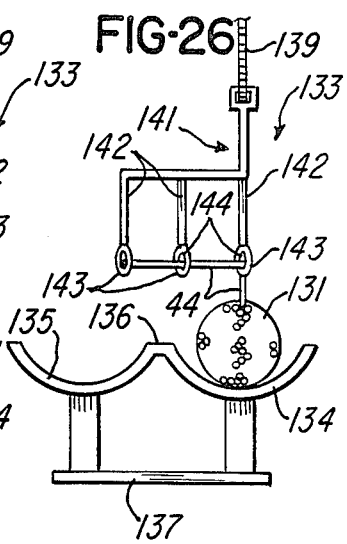

Each device or stripper 141 may also be considered a wire hanger or support which has a downwardly depending arm 142 which may be straight or roughly Z-shaped; and each arm terminates in a lower bulbous end 143 having a rod receiving opening 144 therein for receiving therethrough an extruded rod 44 which is to be separated from its bundle 131 in the manner illustrated in FIG. 23 for example. To provide a separating action for a particular extruded rod 44, the forward end of such rod is inserted in the opening 144 of a stripper 141 which has a straight arm as shown by dotted lines at 146 whereupon another stripper 141 with a Z-shaped arm 142 moves into position and the end of rod 44 is inserted in the opening 144 in the Z-shaped arm followed by a third stripper which is similar to the second. The strippers 141 strip or separate each extruded rod 44 from its bundle 131 which is disposed in portion 134 and deposit same over portion 135 of the apparatus 133.

Once an extruded rod is disposed over portion 135, it can be held in position allowing the supporting strippers 141 to slide away therefrom so that the rod will drop into portion 135. The use of apparatus 133 and associated method enables each of the extruded rods 44 to be pulled away from the extruded rod bundle and deposited in portion 135 with minimal bending or otherwise distorting same.

Figure 27:
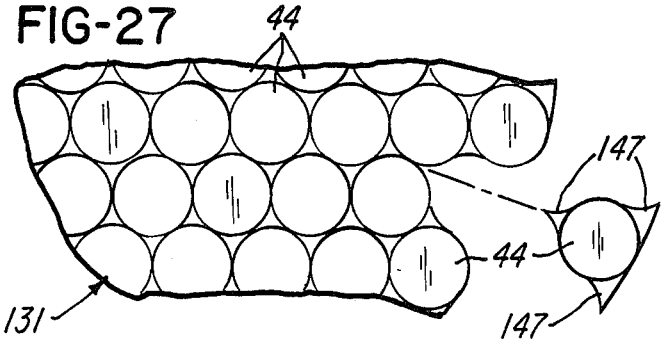
FIG. 27 is an enlarged fragmentary view illustrating the weakly bonded or held-together extruded rods after extrusion thereof and illustrating irregular solidified deposits of frangible filler material defining the outside portions thereof and with such frangible filler material being shown in an exaggerated manner.
Figure 28:
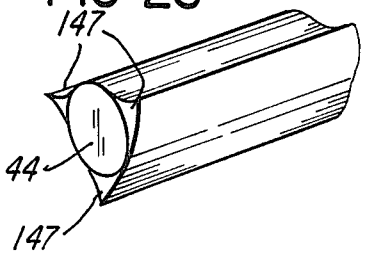
FIG. 28 is an enlarged isometric view of a typical extruded rod with irregular solidified deposits of filler material thereon.
Figure 29:
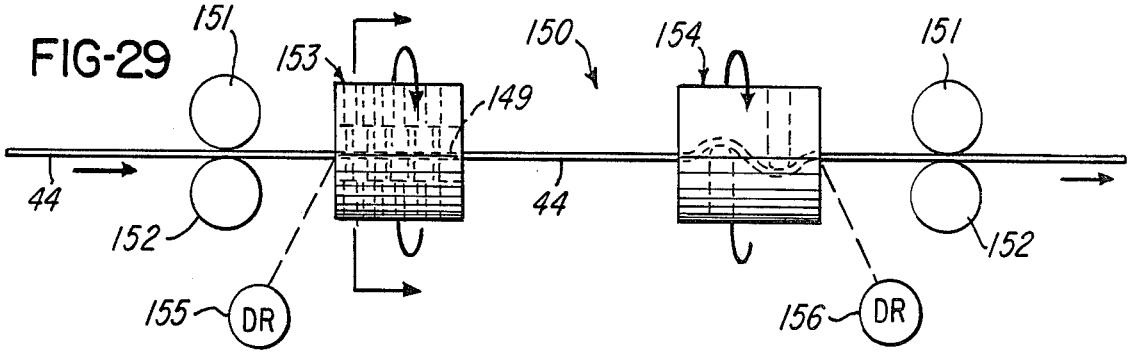
FIG. 29 is a schematic view illustrating a typical extruded rod being moved through apparatus to remove, by shaving, the irregular solidified deposits of filler material therefrom and to straighten such typical rod, if needed.
Figure 30:
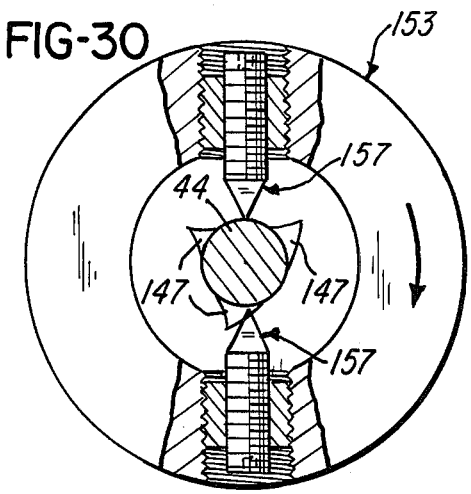
FIG. 30 is an enlarged cross-sectional view showing adjustable rotatable cutters comprising the apparatus of FIG. 29 prior to commencing of the cutting or shaving action.

Each rod pulled away from the extruded rod bundle has solidified powdered filler means thereon as shown typically at three locations each designated by the same reference numeral 147 in FIGS. 27 and 28. The extruded rods are then serially moved through a rod cleaning apparatus in the form of a rod shaving and straightening apparatus 150 as shown in FIG. 29. Each extruded rod 44 is aided in its movement through apparatus 150 by a pair of cooperating feed rolls 151 and 152 at each end which move the rod in a substantially rectilinear path. Each extruded rod 44 is moved through a rotary shaving device or a rotatable or rotary shaver 153 and then through a conventional rod straightener 154. The rotatable shaver 153 has an opening 149 therein for receiving the rod 44 therethrough. The rotatable shaver 153 is rotated around the rod 44, as the rod is moved through opening 149, by a suitable drive mechanism 155 and the straightener 154 is also rotated around the rod 44 by a suitable drive mechanism 156.

Figure 31:
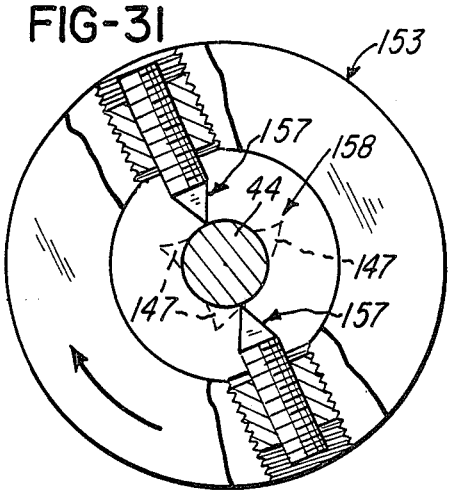
FIG. 31 is a view similar to FIG. 30 illustrating the cutters of FIG. 30 in a rotated position after the shaving action has been completed.

The rotatable shaver 153 has a plurality of five sets of adjustable rod-shaving cutters with each cutter of each set being designated by the same reference numeral 157. Thus, each rod 44 is moved through apparatus 150 in a rectilinear path and the rotary shaver 153 is rotated about the extruded rod as it is moved therethrough. It will be appreciated that the cutters cut away the solidified material 147, as shown at 158 in FIG. 31. The dotted lines in FIG. 31 show the position of material 147 prior to cutting or shaving thereof.

Figure 32:
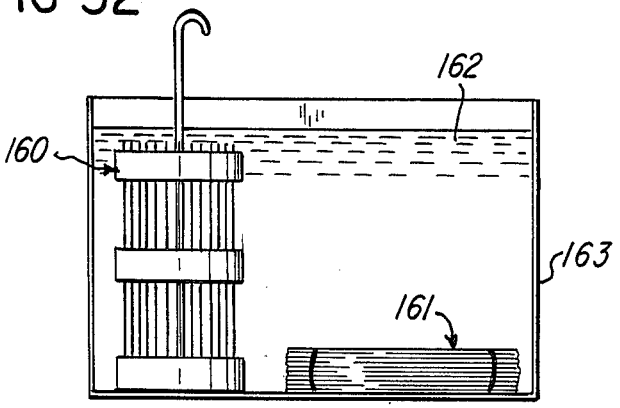
FIG. 32 illustrates certain extruded and shaved rods in straight form and in a coiled form disposed within an acid tank to acid clean same.

The extruded rods, after passing same through the rotary shaver 153 and straightener 154, may be cut to a predetermined length and a plurality thereof placed in a cleaning fixture 160 or coiled in coil 161 (FIG. 32) and then dipped or submerged in a suitable acid bath consisting of acid 162 in a tank 163, to completely clean same so that only the desired finished rod material remains. The rods whether straight or coiled may be dipped in a series of suitable acid baths.

Figure 35:
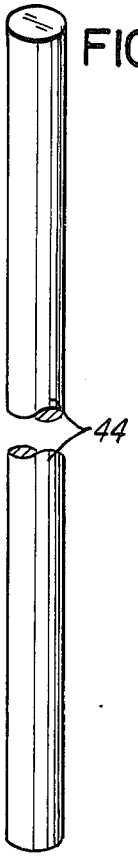
FIG. 35 is a view with the center portion broken away of an extruded rod made in accordance with the method and utilizing the apparatus of this invention.

The rods may also be further cleaned by cleaning same in a suitable alkaline cleaner using a soap additive, or the like. The rods may then be suitably washed with plain tap water and dried whereupon such rods may be cut to length and used in their ultimate application such as welding rods or the like. A typical extruded rod 44 which has been fully cleaned is shown in FIG. 35.

Figure 33:
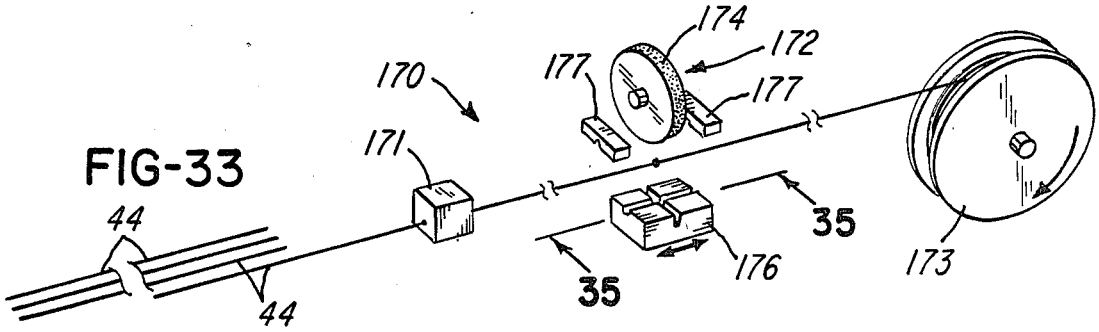
FIG. 33 illustrates an apparatus and method for welding together, and end-to-end, fully cleaned wires.
Figure 34:
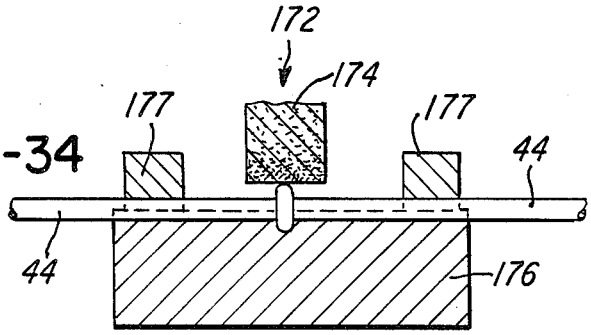
FIG. 34 is an enlarged view illustrating a grinding device which comprises the apparatus of FIG. 33.

The acid cleaned extruded rods 44 may also be welded end-to-end to define a rod or wire of extended length using apparatus 170 as shown in FIG. 33. The apparatus 170 comprises a flash welder 171 and a grinding apparatus 172 so as to define acid cleaned rods of extended length which are suitably wound on a supply reel 173. The grinding apparatus 172 is illustrated in more detail in FIG. 34 and such apparatus comprises a grinder 174, a backup anvil 176 and a pair of clamps 177 which hold the wire in position in a predetermined manner. The grinding apparatus 172 is used to grind away any excess material which results due to the welding of extruded rods end-to-end utilizing the flash welder 171.

The extruded wire made in accordance with the teachings of this invention is particularly adapted to produce solid wire in the form of solid weld wire of the type used as filler wire to apply hard facing on turbine blades of gas turbine engines, or the like. However, it will be appreciated that the method, apparatus, and wire of this invention may have other applications or uses as will be recognized by those skilled in the art.

In this disclosure of the invention reference is made to the use of a coating material for coating the rods 44 prior to extrusion using the filled billet technique; and, it will be appreciated that any suitable coating material may be used, which is compatible with the metal used to make the rods 44. Further, such coating material should also be compatible with the temperatures and pressures which are involved, namely temperatures for preheating each of the filled billets of approximately 1000° F. to 3000° F., temperatures at the start of extrusion of approximately 800° F. to 2800° F. and temperatures at the end of extrusion of approximately 800° F. to 3200° F. The extrusion pressures range from 50 to 110 tons per square inch; and the extrusion speeds range from 50 to 500 inches per minute. Any coating material known in the art and capable of meeting the above parameters may be used and an exemplary coating material will be described subsequently.

Reference is made herein to the use of powdered filler material for use in the can between the rods 44 individually and the rods and the can 40. Any suitable powdered filler material known in the art, such as suitable powdered metal or other powdered material now to be further described, may be used for this purpose and which is compatible with the temperatures and pressures disclosed in this specification.

As mentioned earlier, some of the characteristics of a filler means or powder which provide satisfactory results include those specified in the U.S. Pat. No. 4,209,122 which was mentioned earlier. Some characteristics will be repeated here for continuity of discussion and include low cost, quick solubility in mineral acids, chemical stability with the alloy of the rods, and coextrudability with the rods being extruded. Filler powder made of low carbon steel generally meets the above characteristics for coextruding rods of many high performance and high temperature alloys, which are the alloys for which this invention is especially applicable.

However, as is known in the art, steel filler powder can be made stiffer and thereby more uniformly coextrudable with high temperature alloys by blending into the steel powder a refractory type powder consisting of a quantity of small diameter refractory ceramic particles to form a composite powder. The ceramic particles provide the stiffening or embrittling phase also mentioned in the background of the invention of this application. If the stiffening phase is present in sufficient amounts, the filler becomes brittle enough, or frangible enough to separate the extruded rods by fracturing the filler with the small mechanical forces mentioned earlier. The chosen particle sizes of the stiffening and embrittling phase is somewhat less than that of the metallic phase. Minus 200 mesh ceramic powder blended in 100 mesh steel powder is a typical example. In addition, successful coextrudable and friable/frangible filler powders can be produced by blends of 5 to 30 volume percent alumina, magnesia, or chromia in steel, or Monel. Likewise, similar additions of red iron oxide in steel may be used. Even though the ceramic particles are sometimes acid resistant, they can be readily removed, since the matrix metal is readily attacked by acid.

Other filler materials (including those in powder form) can be chosen from naturally or already brittle metals, such as chromium and molybdenum, or nonmetallic materials, such as fluorspar, marble, and strontium carbonate. Clearly, these materials need no embrittling additions because they can be used as they are.

Figure 36:
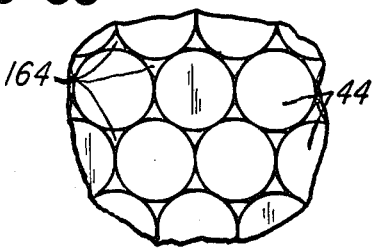
FIG. 36 is an enlarged view showing a portion of a dense pack of rods and coated filler means therebetween, such coated filler means being in the form of solid members.

However, as indicated earlier, and as shown in FIG. 36, the separable filler means instead of being in the form of a powder or powdered material may be in the form of a solid member or members. In particular, it will be seen in FIG. 36 that a central portion of a dense pack is shown and is comprised of solid rods 44 which have solid members 164 disposed therebetween. The members 164 are of roughly triangular cross-sectional configuration and serve to occupy the space between immediately adjacent rods. The triangular members 164 are disposed in position prior to welding the dense pack, in manner previously described; and, it will also be appreciated that the members 164 are coated with a suitable coating which serves as a parting agent and is preferably the same parting agent that is used on the rods 44 themselves.

Although the solid members 164 are shown in this example as being of triangular cross-sectional configuration, such members may be of different shapes depending on the shapes of the rods 44 themselves. In addition, solid members may be shaped to fit the inside surface of their associated can used to contain the rods to be extruded. Further, it will be appreciated that any combination and placement of powdered material and coated members 164 may be utilized within a given can for the same purposes as the powdered filler material.

In some applications of this invention it may be desirable to insert one or more comparatively larger size coated members to occupy space within a can where only a selected predetermined number of rods 44 are to be extruded. Further, the rods 44 need not necessarily be of circular cross-section but may be of any desired cross-section known in the art.

The rods 44 to be extruded may be cast rods, wrought rods, or sintered rods. As is known in the art, cast rods are made by solidifying a suitable molten metal in a mold; wrought rods are made by a suitable process such as extrusion, swaging, rolling, or drawing; and the sintered rods are basically made by compacting suitable metal particles, followed by, or simultaneous with controlled heating to provide fusion or bonding thereof. The rods to be further processed in accordance with this invention may be partially sintered and partially solid.

It will also be appreciated that in some applications of this invention a "rod" being processed may be enclosed in a tube. In this instance a powdered material such as the material used to make rods 44 may be disposed within a tubular member and held therein with suitable end plugs. Steel tubing and plugs are a common choice, because of their cost, availability, and general coextrudability with the alloys of interest. After putting such powdered material in such tube, its outside surfaces would be suitably coated with a parting agent or coating material, such as the coating material disclosed and used on the outside surface of the rods 44. Plugged tubes would then be extruded in accordance with the teachings of this invention to form consolidated wire within the tubes. The steel clad wires are then separated from the can and each other as previously described and the extruded tubing is removed therefrom by suitable means including grinding and/or dissolving using acid, or the like.

In this example of the invention reference has been made to a particular size billet being extruded so that it is reduced in diameter from approximately 6 inches to 1½ inches. However, it would be appreciated that the initial billet to be extruded could be as small as 1 inch in diameter and as large as 12 inches in diameter, or even larger. Furthermore, the rods which are disposed within the billet for extrusion may be of any suitable size known in the art. In short, the size of the overall billet and the size or sizes of the rods within the billet to be extruded may vary and may be as known in the art.

The coating agent which is used on the outside surface of the rods 44; on the outside surfaces of the triangular members 164, where such members are utilized; and on the inside surface of the cylindrical can may be any suitable parting agent known in the art and may be applied as disclosed herein.

However, such coating materials or parting agent is preferably in the form of a glass powder suspended in a liquid (such as water) which is utilized together with a binder, such as a liquid resin, or the like, to form a solution and such solution is applied by any suitable means known in the art on the surfaces which are to be coated. In this example of the invention it will be seen that the rods 44 are coated by dipping in the liquid coating material 74 provided in tank 75.

From the above description it is seen that there are at least three features of this invention which may be used in any combination or independently to assure better separation of extruded rods or members made by the filled billet extrusion technique. These three features include coating the rods with a suitable parting agent, fixing the rods with minimum space between them, and coextruding the rods using a friable or frangible filler means which may be in the form of a powder or other form as described in this specification.

The acid used in acid bath 162 will vary and depend on the material which is to be removed from the extruded rods. Examples of acids may be sulphuric, muriatic, nitric, etc. Likewise, the cleanser used as the alkaline cleanser may have a suitable soap additive or the like.

Thus, it is seen from the foregoing specification that this invention provides a new method, apparatus, and product which are more cost effective and superior to previous methods, apparatus, and products.

While the forms and method of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the words "the improvement" and sets forth what is believed to be new in each claim according to this invention in the portion of each claim that is disposed after the words "the improvement" whereby it is believed that each claim sets forth novel, useful, and unobvious invention within the purview of the Patent Statute.

What is claimed is:

1. In a method of manufacturing wire and similar elongate members comprising the steps of; providing a cylindrical can which has a closed end, an open end, and a central longitudinal axis; disposing a plurality of rods into said can through its open end in parallel relation with each other and parallel to said longitudinal axis; introducing separable filler means into said can to fill the spaces between said rods and between said rods and the interior surface of said can; attaching a cap to said open end of said can to thus complete a filled billet; heating said filled billet to a temperature approximately equal to the forging temperature of said rods; extruding said filled billet through an extrusion die to effect an area reduction in the cross section thereof and of said rods therewithin; cooling the extruded filled billet; and removing the extruded can from around the extruded rods; the improvement comprising the further steps of, placino said rods in adjoining side-by-side relation to define a geometric pattern, fixing together at their ends those rods defining the periphery of said pattern to define a dense pack of said rods, said placing and fixing steps being achieved prior to said disposing step, said dense pack and hence said rods being adapted to fit snugly within said can during said disposing step, and said fixing step assuring that during said extruding step said rods are reduced in cross-sectional area in a better controlled manner.

2. A method as set forth in claim 1 in which said placing step comprises placing said rods in two preliminary patterns with each preliminary pattern having one-half of said rods in adjoining side-by-side relation, said fixing step comprises fixing together at their ends rods defining the periphery of each preliminary pattern to define a half pack which consists of one-half of a dense pack and then fixing two half packs together to define said geometric pattern and said dense pack.

3. A method as set forth in claim 1 in which said fixing step comprises fixing by welding.

4. A method as set forth in claim 2 in which said fixing step comprises welding together at their ends those rods defining the periphery of each preliminary pattern and half pack with a weld bead which extends along the central portions of the ends of associated rods to define an associated half pack and then welding said two half packs together.

5. A method as set forth in claim 1 in which said placing step comprises placing said rods into fixture means and thus define two substantially identical patterns each having one-half said rods in adjoining side-by-side relation, said fixing step comprises the step of welding together at their ends rods defining the periphery of each preliminary pattern to define a half pack which consists of one-half of said dense pack, and then welding two half packs together to define said dense pack.

6. A method as set forth in claim 5 in which said fixture means comprises adjustable fixture means, said placing step comprises disposing half of said rods in said fixture means to enable compaction thereof and arrangement of rods in a trapezoidal pattern when viewed from an end thereof, said trapezoidal pattern having long and short parallel sides and non-parallel sides of equal length, said trapezoidal pattern defining an associated one of said two preliminary patterns, said welding step comprises welding together at their ends rods defining the periphery of each trapezoidal pattern and then welding two half packs together along the long parallel sides of their trapezoidal configurations to define said dense pack as a hexagonal dense pack when viewed from an end thereof.

7. A method as set forth in claim 6 in which said welding step further comprises welding together at their ends certain rods disposed within the periphery of each trapezoidal pattern.

8. A method as set forth in claim 7 in which said certain rods consist of rods arranged in a V-shaped pattern within said periphery of each trapezoidal pattern whereby said welding step results in having rods welded together at their ends so that each half pack has rods welded to define three isosceles triangles when viewed from an end thereof.

9. A method as set forth in claim 6 in which said can is a cylindrical can with a right circular cylindrical inside surface, said disposing step comprises disposing said dense pack of hexagonal configuration within said can and with corners thereof against said cylindrical inside surface, and said disposing step further comprises placing rods in each space between a straight wall of said hexagonal dense pack and an adjacent arcuate portion of the cylindrical inside surface of said wall.

10. A method as set forth in claim 9 in which said filler means is in the form of a filler powder and said introducing step comprises introducing prior to said disposing step a predetermined thickness of said filler powder into said can against the inside surface of said closed end with said can disposed upright, followed by introducing said filler powder between said rods and said cylindrical inside surface of said can, and followed by introducing a predetermined top thickness of said filler powder on the top surface of said hexagonal dense pack and within said cylindrical inside surface of said can.

11. A method as set forth in claim 10 and further comprising the step of welding a cover having a vent hole therein over said open end.

12. A method as set forth in claim 11 and comprising the further step of vibrating said can with said rods therein during said introducing step to compact said filler powder introduced into said can.

13. A method as set forth in claim 1 and further comprising the preparation step of coating said rods with a coating material prior to said disposing step, said coating material enabling said rods to be more easily separated from each other following said extrusion step.

14. A method as set forth in claim 13 in which said preparation step comprises providing said coating material which is in the form of a substantially liquid material comprised of glass powder suspended in liquid with a binder, said coating step comprises standing said rods in their ends in a device which holds same in parallel spaced-apart relation, and dipping said rods in a tank containing said coating material to thereby provide a coating on the outside surfaces of said rods.

15. A method as set forth ih claim 14 in which said disposing step comprises the preparation step of coating the inside surface of said can with a coating material which enables said separation of said extruded can from around said extruded rods following said extruding step, said coating material coated on the inside surface of said can being the same material as the coating material used on said rods.

16. A method as set forth in claim 1 and further comprising the steps prior to said placing step of cutting at least one slot in and along substantially the full length of said can; inserting and attaching a strip in said slot so that during said extruding step said strip is also extruded with said filled billet; and following said extruding step, cutting away at least one end of said extruded billet to expose the associated ends of said extrude rods and an associated end of said extruded can, removing the extruded strip to define a weakened zone along said extruded can, grasping said associated end of said extruded can, and mechanically stripping said extruded can away from said extruded rods by splitting said extruded can along said weakened zone.

17. A method as set forth in claim 16 in which said preparation step comprises cutting said slot parallel to said longitudinal axis.

18. A method as set forth in claim 17 and further comprising the steps of cutting at least another slot parallel to said axis; inserting and attaching another strip in said other slot; and following said extruding step and said cutting away step, also removing said other extruded strip to define another weakened zone, grasping said extruded can between said zones, and mechanically stripping said can away from said extruded rods by stripping away those portions thereof between said weakened zones.

19. A method as set forth in claim 16 and comprising the further step following said step of removing said extruded strip of further cutting substantially completely through said can with a cutter so that said weakened zone is further weakened or eliminated.

20. A method as set forth in claim 1 in which said step of disposing rods comprises disposing said rods which are defined as plugged tubes containing powder wherein during said extrusion step said powder becomes consolidated wire.

21. A method in claim 20 in which said plugged tubes are tubes made of steel.

22. In a method of manufacturing wire and similar elongate members comprising the steps of; providing a cylindrical can which has a closed end, an open end, and a central longitudinal axis; disposing a plurality of rods into said can through its open end in parallel relation with each other and parallel to said longitudinal axis; introducing filler means into said can to fill the spaces between said rods and between said rods and the interior surface of said can; attaching a cap to said open end of said can to thus complete a filled billet; heating said filled billet to a temperature approximately equal to the forging temperature of said rods; extruding said filled billet through an extrusion die to effect an area reduction in the cross-section thereof and of said rods therewithin; cooling the extruded filled billet; and removing the extruded can from around the extruded rods; the improvement comprising the steps prior to said placing step of cutting at least one slot in and along substantially the full length of said can and partially through the thickness of said can; inserting a strip in said slot and attaching same to said can so that during said extruding step said strip is also extruded with said filled billet; and following said extruding step, cutting away at least one end of said extruded billet to expose the associated ends of said extruded rods and an associated end of said extruded can, removing the extruded strip to define a weakened zone along said extruded can, grasping said associated end of said extruded can, and mechanically stripping said extruded can away from said extruded rods by splitting said extruded can along said weakened zone.

23. A method as set forth in claim 22 in which said preparation step comprises cutting said slot parallel to said longitudinal axis.

24. A method as set forth in claim 23 and further comprising the steps of cutting at least another slot in and along substantially the full length of said can parallel to said longitudinal axis and also partially through the thickness of said can, inserting another strip in said other slot; and attaching said other strip to said can so that during said extruding step said other strip is also extruded with said filled billet; and following said extruding step and said cutting away step also removing said other extruded strip to define another weakened zone along said extruded can, said grasping step comprising grasping said associated end of said extruded can at spaced-apart locations between said weakened zones, and said mechanically stripping step comprises mechanically stripping the associated portion of said extruded can between weakened zones away from said extruded rods by splitting said can along said weakened zones.

25. A method as set forth in claim 24 and comprising the further step following said step of removing said extruded strips of further cutting substantially completely through said can with a rotary cutter so that said weakened zones are further weakened or eliminated.

26. A method as set forth in claim 25 in which said steps of cutting said slots in said can prior to said extruding step comprises cutting same at diametrically opposed locations.

27. A method as set forth in claim 26 in which during said step of further cutting a stabilizing guide is disposed in one of said weakened zones and the other of said weakened zones serves as a guide for said rotary cutter.

28. A method as set forth in claim 22 and comprising the further step of compressing the exterior of said can prior to said grasping step thereby substantially loosen said can from said extruded rods.

29. A method as set forth in claim 28 in which said compressing step comprises compressing said can using roll means.

30. A method as set forth in claim 22 in which said step of disposing rods comprises disposing said rods which are defined as plugged tubes containing powder wherein during said extrusion step said powder becomes consolidated wire.

31. A method in claim 30 in which said plugged tubes are tubes made of steel.

32. In a method of manufacturing wire and similar elongate members comprising the steps of; providing a cylindrical can which has a closed end, an open end, and a central longitudinal axis; disposing a plurality of rods into said can through its open end in parallel relation with each other and parallel to said longitudinal axis; introducing separable filler means into said can to fill the spaced between said rods and between said rods and the interior surface of said can; attaching a cap to said open end of said can to thus complete a filled billet; heating said filled billet to a temperature approximately equal to the forging temperature of said rods; extruding said filled billet through an extrusion die to effect an area reduction in the cross section thereof and of said rods therewithin; cooling the extruded filled billet; and removing the extruded can from around the extruded rods; the improvement wherein said step of introducing separable filler means comprises introducing solid separable filler means which during said extruding step remains or becomes brittle or frangible, and comprising the further step of separating the extruded rods from each other by breaking said brittle or frangible filler means with comparatively small mechanical forces.

33. A method as set forth in claim 32 in which said step of introducing solid separable filler means comprises the step of introducing a powdered filler material which is rapidly soluble in a suitable solution, extrudable with said rods without attacking same, and capable of providing extrusion stiffness to the filled billet.

34. A method as set forth in claim 33 in which said step of introducing a powdered filler material comprises providing said powdered filler material as a blend of refractory ceramic particles and metallic particles.

35. A method as set forth in claim 34 in which said ceramic particles of said blend are roughly one half the size of said metallic particles.

36. A method as set forth in claim 34 and comprising the further step of coating said rods and the inside surface of said cylindrical can with coating means which serves as a parting agent.

37. A method as set forth in claim 33 in which said step of introducing solid separable filler means comprises introducing a brittle metal filler means.

38. A method as set forth in claim 32 in which said step of separating the extruded rods from each other comprises breaking said brittle or frangible filler means with said comparatively small mechanical forces which are of the type produced manually with simple hammering or similar method.

39. A method as set forth in claim 32 in which said step of introducing solid separable filler means comprises compacting said solid separable filler means while leaving said can intact.

40. A method as set forth in claim 33 and comprising the further step of vibrating said cylindrical can and its contents to compact and densify said powdered filler material.

41. In a method of manufacturing wire and similar elongate members comprising the steps of; providing a cylindrical can which has a closed end, an open end, and a central longitudinal axis; disposing a plurality of rods into said can through its open end in parallel relation with each other and parallel to said longitudinal axis; introducing separable filler means which is in solid form into said can to fill the spaces between said rods and between said rods and the interior surface of said can; attaching a cap to said open end of said can to thus complete a filled billet; heating said filled billet to a temperature approximately equal to the forging temperature of said rods; extruding said filled billet through an extrusion die to effect an area reduction in the cross section thereof and of said rods therewithin; cooling the extruded filled billet; and removing the extruded can from around the extruded rods; the improvement comprising the preparation step of coating said rods with a substantially vitreous coating material prior to said disposing step, said coating material serving as a parting agent, and said coating material and separable filler means cooperating to enable said rods to be more easily separated from each other following said extrusion step.

42. A method as set forth in claim 41 in which said preparation step comprises providing said substantially vitreous coating material which initially is in the form of a substantially liquid material comprised of glass powder suspended in water with a binder, said coating step comprises standing said rods on their ends in a device which holds same in parallel spaced-apart relation, dipping said rods in a tank containing said coating material to thereby provide a coating on the outside surfaces of said rods, and drying the rods with liquid material thereon to provide a substantially continuous glass coating about the entire surface of each rod.

43. A method as set forth in claim 42 in which said disposing step comprises the preparation step of coating the inside surface of said can with a coating material which enables said separation of said extruded can from around said extruded rods following said extruding step, said coating material coated on the inside surface of said can being the same material as the coating material used on said rods.

44. A method as set forth in claim 41 in which said step of introducing separable filler means comprises introducing chromium.

45. A method as set forth in claim 41 in which said step of introducing separable filler means comprises introducing molybdenum.

46. A method as set forth in claim 41 in which said step of introducing separable filler means comprises introducing marble.

47. A method as set forth in claim 41 in which said step of introducing separable filler means comprises introducing fluorspar.

48. A method as set forth in claim 41 in which said step if introducing separable filler means comprises introducing strontium carbonate.

* * * * *